US006276600B1

(12) United States Patent
Rigby

(10) Patent No.: US 6,276,600 B1
(45) Date of Patent: Aug. 21, 2001

(54) HINGED-LID PACK FOR CIGARETTES OR THE LIKE

(75) Inventor: William Roger Rigby, Midlothian, VA (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/552,300

(22) Filed: Apr. 18, 2000

(51) Int. Cl.[7] ..... B65D 43/16

(52) U.S. Cl. ..... 229/128; 206/273; 229/160.1

(58) Field of Search ..... 229/128, 146, 229/160.1; 206/268, 273

(56) References Cited

U.S. PATENT DOCUMENTS

| | | |
|---|---|---|
| 2,369,391 | 2/1945 | Ringler . |
| 2,848,152 | 8/1958 | Geiger, Sr. . |
| 3,963,173 | 6/1976 | Stone . |
| 4,215,783 | 8/1980 | VanderLugt, Jr. . |
| 4,294,399 | 10/1981 | Wilfer . |
| 4,392,338 | 7/1983 | Fox . |
| 4,526,317 | 7/1985 | Cassidy . |
| 4,753,383 | 6/1988 | Focke et al. . |
| 4,753,384 | 6/1988 | Focke et al. . |
| 4,852,734 | 8/1989 | Allen et al. . |
| 4,948,038 | 8/1990 | Moeller . |
| 5,044,550 | 9/1991 | Lamm . |
| 5,207,322 | 5/1993 | Focke et al. . |
| 5,307,925 | 5/1994 | Focke et al. . |
| 5,314,114 | 5/1994 | Stone . |
| 5,341,925 | 8/1994 | Fleenor et al. . |
| 5,392,905 | 2/1995 | Focke et al. . |
| 5,405,007 | 4/1995 | Iwahashi . |
| 5,478,011 | 12/1995 | Pham . |
| 5,529,180 | 6/1996 | Paolucci et al. . |
| 5,564,563 | 10/1996 | Focke et al. . |
| 5,586,648 | 12/1996 | Focke et al. . |
| 5,806,671 | 9/1998 | Focke et al. . |
| 5,823,331 | 10/1998 | Manservigi et al. . |
| 5,896,948 | 4/1999 | Suur-Askola et al. . |
| 5,896,984 | 4/1999 | Focke et al. . |
| 5,904,244 | 5/1999 | Focke et al. . |
| 5,924,627 | 7/1999 | Wilder et al. . |
| 5,950,909 | 9/1999 | Peterson et al. . |
| 5,954,204 | 9/1999 | Grabowski . |
| 5,988,007 | 11/1999 | Nishimura . |
| 5,988,429 | 11/1999 | Coe . |
| 5,988,496 | 11/1999 | Bruna . |
| 5,996,797 | 12/1999 | Flaig . |
| 5,996,884 | 12/1999 | Frisk et al. . |

FOREIGN PATENT DOCUMENTS

| | | |
|---|---|---|
| 29618848U1 | 5/1998 | (DE) . |
| 29814612U1 | 12/1998 | (DE) . |
| 0801010A1 | 3/1997 | (EP) . |
| 0835827A2 | 8/1997 | (EP) . |
| 0884247A1 | 12/1998 | (EP) . |
| 0894737A1 | 2/1999 | (EP) . |
| 0895940A2 | 2/1999 | (EP) . |
| 0635437B1 | 5/1999 | (EP) . |
| WO98/50287 | 11/1998 | (WO) . |

*Primary Examiner*—Gary E. Elkins
(74) *Attorney, Agent, or Firm*—D. L. Bowman; T. B. McDaniel; R. L. Schmalz

(57) ABSTRACT

This invention relates to a modification for a round-corner flip top cigarette pack and the like. Such structures of this type, generally, relocate the inner frame in order to improve reclosability of the pack.

16 Claims, 6 Drawing Sheets

HINGED-LID PACK FOR CIGARETTES OR THE LIKE

BACKGROUND OF THE INVENTION

1. Field of the Invention

This invention relates to a modification for a round-corner container with a reclosable hinger-lid. Such structures of this type, generally, relocated the inner frame in order to improve reclosability.

2. Description of the Related Art

As shown in FIG. 1, round-corner flip top boxes 2 that are currently in the market will pop open slightly after their initial opening thus creating a "smiley face" 4 appearance on the front of the package. There have been many attempts to resolve this problem. Exemplary of such prior art are U.S. Pat. No. 4,753,384 ('384) to H. Focke et al., entitled "Hinge-Lid Pack for Cigarettes or The Like," U.S. Pat. No. 5,896,984 ('984) to H. Focke et al., entitled "Hinge-Lid Packet for Cigarettes," and European Patent Application 0 894 737 A1 to H. Tambo et al., entitled "Hinged-Lid Pack." While these references employ small catch flaps on the inner frame that engage the lid to hold it shut, they are not aesthetically appealing because the tabs pop out, thereby disrupting the visual flow of the package.

It is also known to employ an inner frame that is tapered, in that it grows larger as you move toward the top of the pack. Exemplary of such prior art is U.S. Pat. No. 5,392,905 ('905) to H. Focke et al., entitled "Hinge-Lid Pack, Especially for Cigarettes." Again, as with the other references, its ever widening shoulder does not work because it is not aesthetically appealing.

It is apparent from the above that there exists a need in the art for a round-corner, flip-top pack which is light weight through simplicity of parts and uniqueness of structure, and which eliminates the "smiley face" appearance, but which at the same time is aesthetically appealing. It is a purpose of this invention to fulfill this and other needs in the art in a manner more apparent to the skilled artisan once given the following disclosure.

SUMMARY OF THE INVENTION

Generally speaking, this invention fulfills these needs by providing a container comprising a round-corner body and a round-corner lid. The lid is hingedly attached to the body along a curved perimeter. The body comprises upright longitudinal edges and has a closed end and an open end. An inner frame with two side panels is secured to the inside of the body. The top of the inner frame extends above the body and the inner frame is partially surrounded by the lid when the lid is in a closed position.

In another further preferred embodiment, the use of the inner frame and the curved hinged lid means improve the reclosability of the pack by substantially eliminating the "smiley face".

The preferred pack, according to this invention, offers the following advantages: lightness in weight; ease of assembly; good stability; excellent durability; and excellent economy. In fact, in many of the preferred embodiments, the factor of durability is optimized to the extent that is considerably higher than heretofore achieved in prior, known packs.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
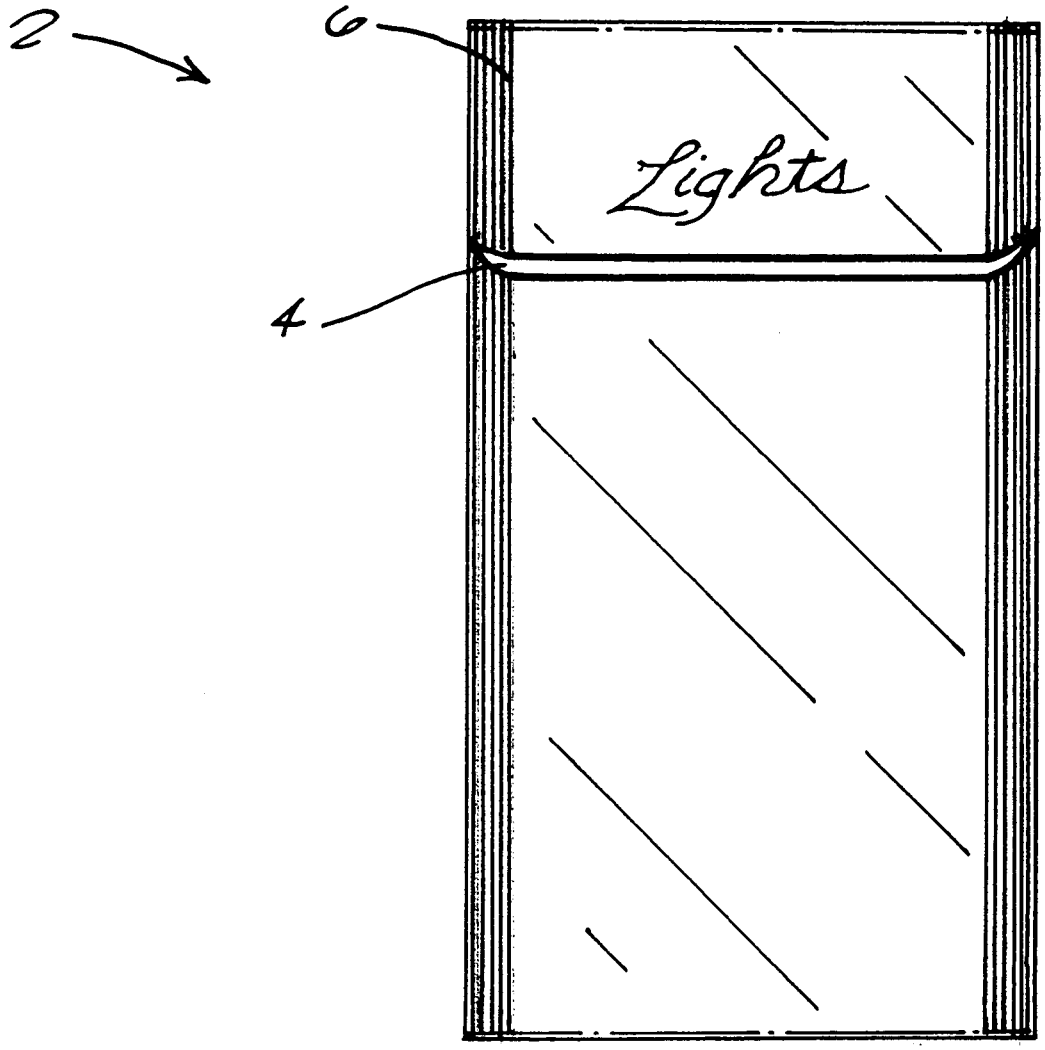
FIG. 1 (PRIOR ART)
FIG. 1 is a schematic illustration of a prior art, hinged-lid pack, showing the "smiley face"

As discussed earlier, FIG. 1 is a schematic illustration showing a conventional round-corner, hinged-lid pack 2. As can be seen in FIG. 1, the pack 2 has developed a "smiley face" 4 which occurs when lid 6 pops opens slightly after the initial opening of the pack 2. The present invention was developed in order to eliminate the "smiley face" 4.

Figure 2:
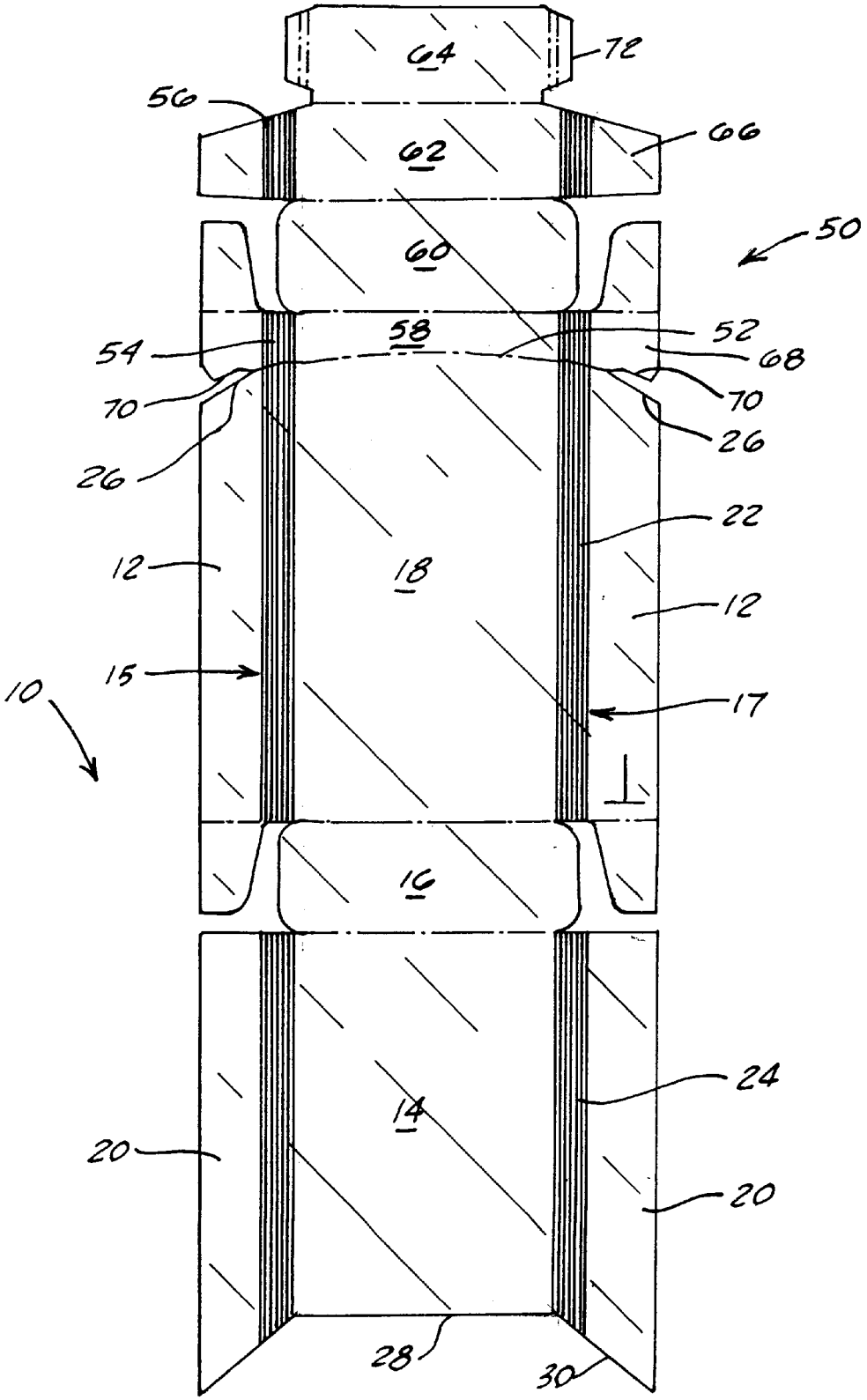
FIG. 2 is a plan view of a blank for creating a round-corner, hinged-lid pack, according to the present invention.

With respect to FIG. 2, there is illustrated an advantageous environment for use of the concepts of the present invention. In particular, the hinged-lid pack blank includes, in part, a pack part 10 and a lid 50 hingedly attached thereto.

The pack part 10 and lid 50, preferably, are constructed of a paperboard substrate, which is, typically, a 0.012 inch thick sheet. Definitively, the term paperboard describes the paper within the thickness range of 0.008 to 0.028 inches. The invention is relevant to the full scope of such a range as applied to packaging and beyond.

The paperboard substrate, typically, receives on the under face or side (the side shown in FIG. 2) a fluidizied mixture of finely particulated minerals and binders as a smooth coating. Minerals such as clay and calcium carbonate are most frequently used. Successive densification and polishing by calendering finishes the mineral coating surface to a high degree of smoothness and a superior graphic print surface which is subsequently applied to the face or side of pack 10 and lid 50.

Pack part 10, typically, comprises a front panel 14, a pack rear panel 18, and a bottom 16. Pack side panels 13 (FIG. 6) are formed from partially overlapping panels 12 and 20.

Lid 50 comprises of a front lid panel 62, a rear lid panel 58, an end panel 60 and a panel extension 64. The side panel 65 (FIG. 6) was formed from overlapping lid side panels 66 and 68. Extension 64 and 72 are folded under front lid panel 62 and attached at panel 62 to add strength to lid 50.

Each rounded longitudinal edge 15, 17 includes a plurality of parallel grooves 22. Lid 50 also includes similar such grooves 56.

Figure 3:
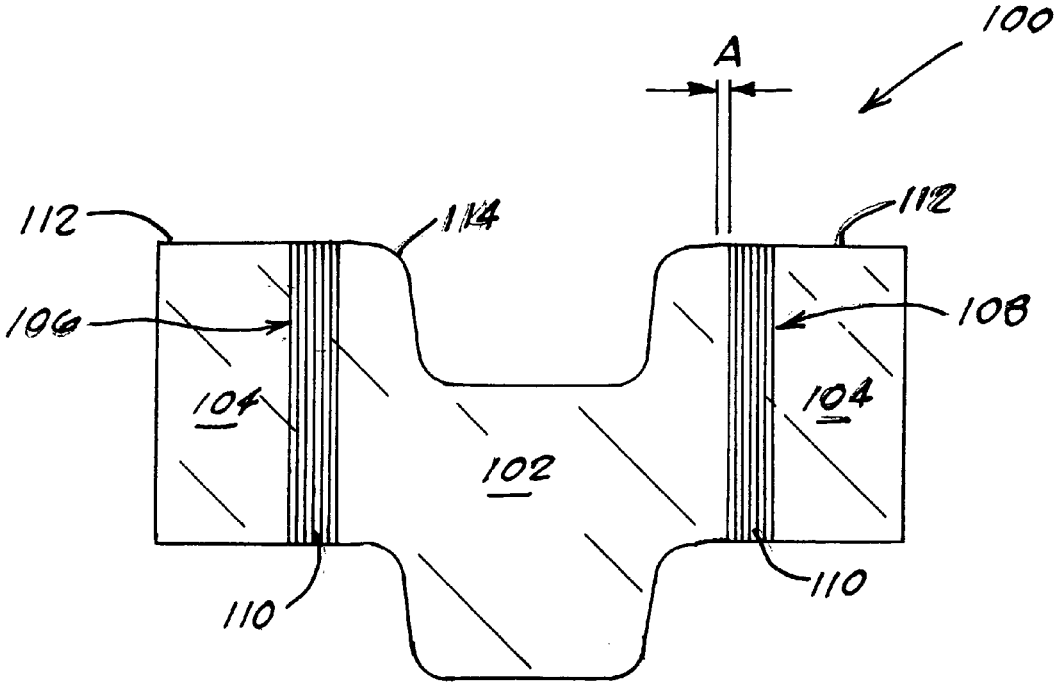
FIG. 3 is a plan view of an inner frame for use in the round-corner, hinged-lid pack, according to the present invention.

As shown in FIG. 3, inner frame 100 is illustrated. It is to be understood that inner frame 100 may be constructed from the same materials as pack 10 and lid 50. Inner frame 100 includes, in part, front panel 102 and collar side panels 104. Inner frame 102 is also provided with rounded, longitudinal collar edges 106, 108 which corresponds with longitudinal edges 15, 17 of pack 10.

In an exemplary embodiment inner frame 100 is inserted into pack 10 in such a way that edge 112 will enter frame 100 and be substantially even with the end of the longitudinal articles 200, typically, cigarettes, which are placed within pack 150 (FIG. 4) while pack 150 is being constructed. Collar front panel 102 is conventionally adhesively connected to the inner side of pack front 14. The upper end of inner frame 100 extends past the perimeter of pack part 10 is then surrounded by lid 50 when hinged-lid pack 150 is in closed position, as shown in FIG. 4.

Figure 4:
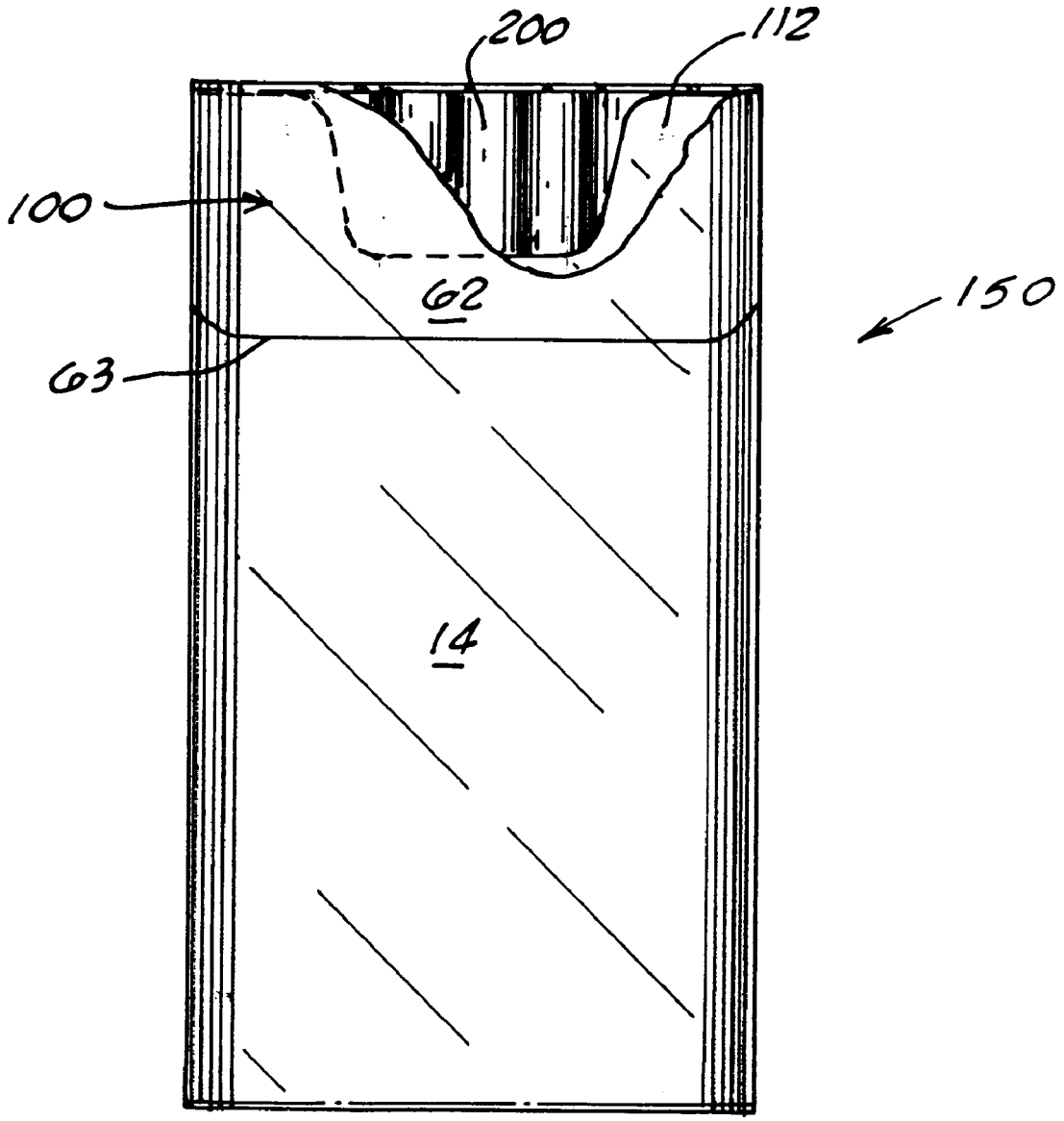
FIG. 4 is a schematic illustration showing the front of the constructed round-corner, hinged-lid pack, according to the present invention.

As shown in FIG. 4, in the closed position, pack part 10 and lid 50 abut one another. These edges are inclined side edges 30 of pack part 10 which are located in the region of pack side panels 13 (FIG. 6) and counter edges 70 located in the region of lid side panels 65 (FIG. 6). The edges are inclined to slope towards the front side of the pack 150. In the region of the pack rear side (FIG. 5) the edges lead to a curved hinge 52 which connects rear panel 18 and lid rear panel 58.

At the front side of the pack 150 (FIG. 4), the lateral butt edges (side edges 26 and counter edges 70) are extended in the form of a front lid edge 63 located in the region of lid front panel 62.

In order to discuss the operation of pack 150, it must be pointed out that pack 150 has the majority of the normal features of a standard round corner-flip top box. See for example the previously discussed '905 reference. However, exemplary differences are as follows.

First, the placement of the top edge 112 of inner frame 100 (FIG. 4) needs to be at or near the top of package 150. However, it is to be understood that this dimensional placement could change depending upon the thickness of the package 150, the length of the front flap 62 on lid 50 and the distance the curved hinge 52 is from the top of package 150. Whichever dimensional placement is used, it must be kept in mind that a friction fit must exist between lid 50 and top edge 112 of inner frame 100 which is loose enough to allow for lid 50 to slip past inner frame 100 and yet be tight enough to hold lid 50 closed without a noticeable "smiley face".

Second, the profile of inner frame 100 (FIG. 3) must exhibit a shoulder area A that would be positioned on an area that is on the furthest most point of inner frame 100 towards the front of package 150. With this configuration, the highest point of inner frame 100 is on the front of package 150 and comes into contact with front lid closure panel 62.

Third, as shown in FIG. 3, the angle/radius geometry 114 begins after shoulder A. Both shoulder A and angle/radius geometry 114 begin after inner frame 100 is transitioned through the round corner to the front surface 14 of package 150. This provides a surface contact area that is critical to the function of the present invention.

Figure 5:
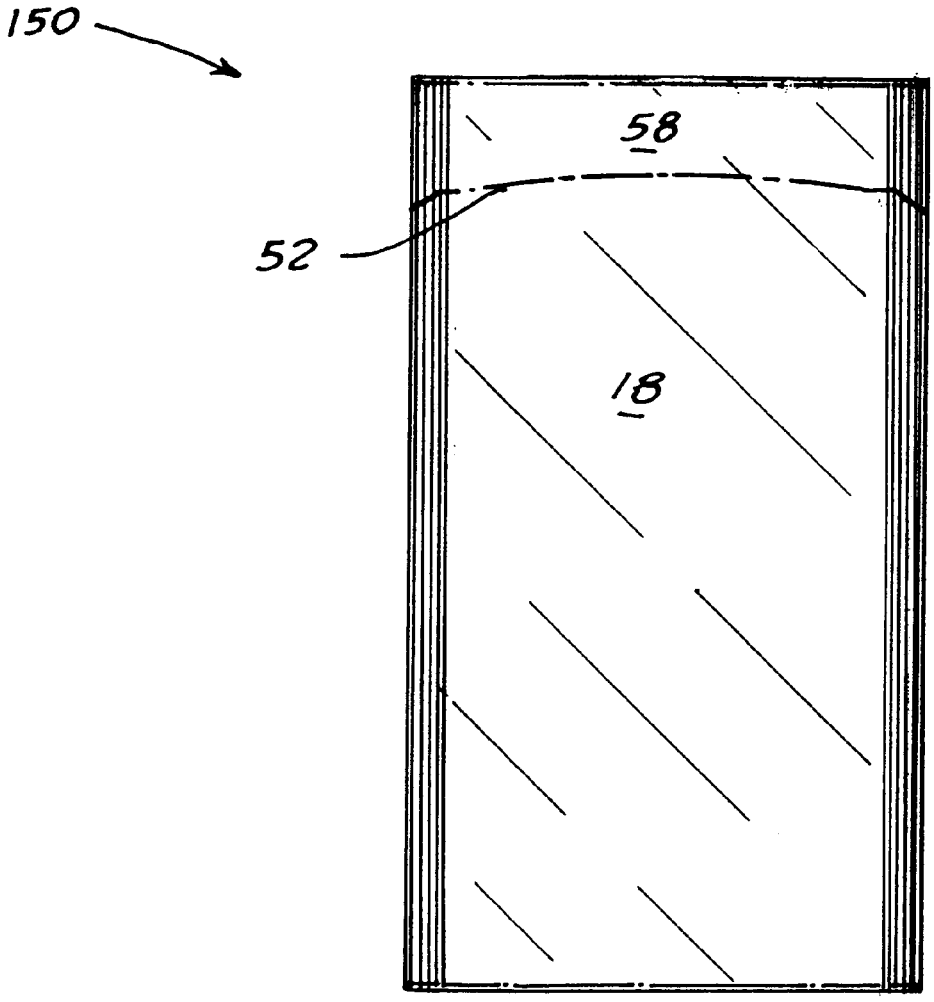
FIG. 5 is a schematic illustration of the back of the constructed round-corner, hinged-lid pack, according to the present invention.
Figure 6:
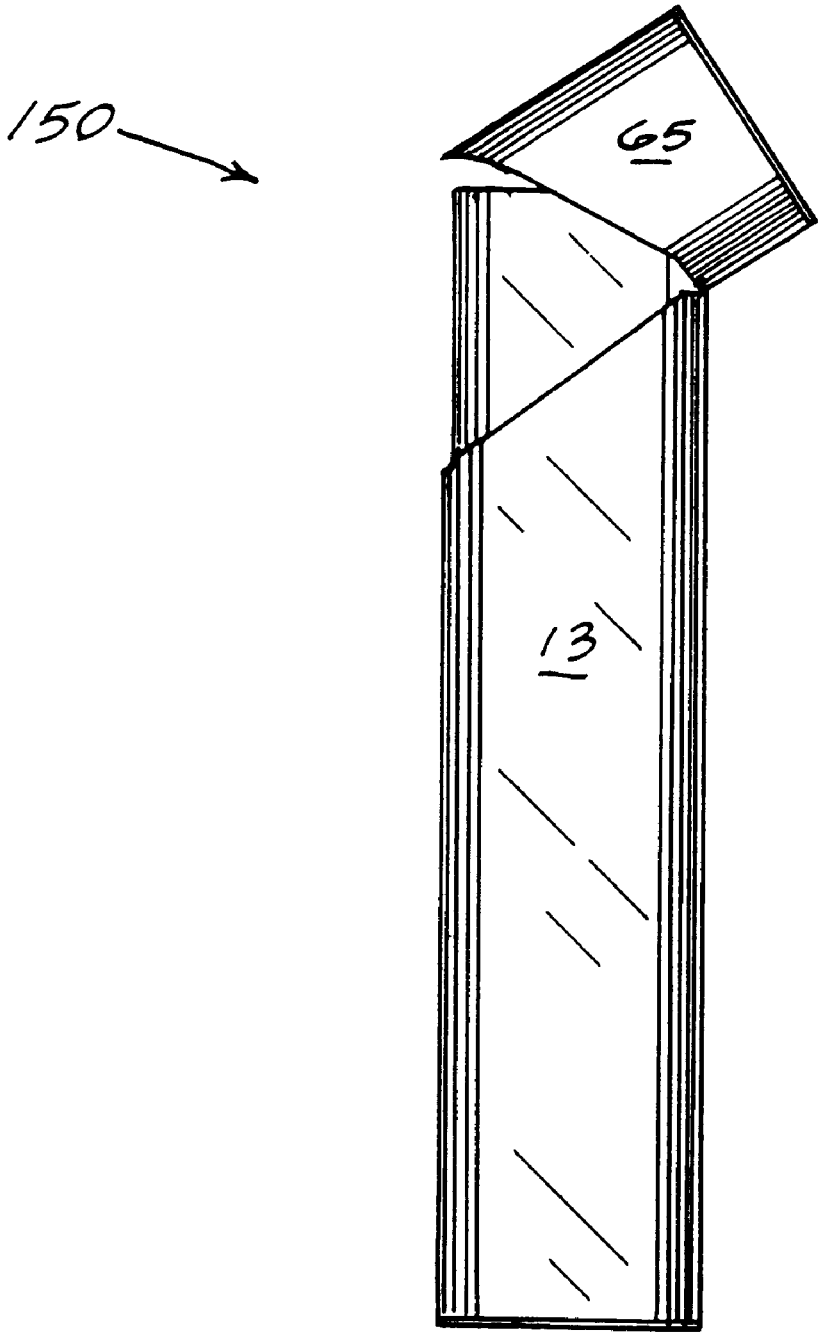
FIG. 6 is a schematic illustration of a side view of the constructed round-corner, hinged-lid pack, according to the present invention.

Finally, FIGS. 2 and 5 show an exemplary curved hinge 52. A curved-shaped hinge increases the resistance of hinge 52 and improves the tightness of the closure of the lid 50 with the pack 14 and inner frame 100 compared to a conventional hinge. With this increased resistance, lid 50 wants to spring back to the closed position, thereby substantially eliminating the problem of "smiley faces."

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A container comprising:

a round-corner body and a round-corner lid hingedly attached to said body along a curved perimeter;

a plurality of elongated articles located substantially within said body and extending out of said body; and an inner frame having a front and two side panels secured to the interior of said body opposite said hinge and extending from said body and said inner frame being substantially surrounded by said lid when said lid is in a closed position.

2. The container as in claim 1, wherein said inner frame comprises:

a plurality of parallel groves located at approximately the perimeter of said front panel and said side panels;

a shoulder located adjacent to said parallel groves; and a radius located adjacent to said shoulder.

3. The container, as in claim 1, wherein said inner frame has a top surface with a u-shaped cavity between said shoulders and radius.

4. The container, as in claim 1, wherein said lid comprises:

a first, second, third and fourth panel such that said first panel is hingedly connected to said body and said second panel is connected to said third panel and said third panel is connected to said fourth panel;

a plurality of parallel grooves substantially located on said first and third panel; and a panel extension hingedly attached to said fourth panel.

5. A container comprising:

a round-corner body and a round-corner lid such that said lid is hingedly secured to said body along a curved perimeter;

a plurality of elongated articles located substantially within said body; and an inner frame having a front panel and two side panels such that a top of said inner frame is located substantially inside said body opposite said hinge and said inner frame is substantially surrounded by said lid when said lid is in a closed position, and wherein said inner frame comprises a plurality of parallel grooves located at approximately the perimeter of said front panel and said side panels, a shoulder located adjacent to said parallel grooves, and a radius located adjacent to said shoulder.

6. The container, as in claim 5, wherein said lid and body are formed from the same substrate by folding said substrate along a curved perimeter to form said lid and said body.

7. The container, as in claim 5, wherein said inner frame has a top surface with a cavity between said shoulder and radius.

8. The container, as in claim 5, wherein said lid comprises:

a first, second, third and fourth panel and said first panel is hingedly connected to said body along a curved perimeter, said second panel is hingedly connected to said third panel, and said third panel is hingedly connected to said fourth panel and wherein said first and third panels comprise a plurality of parallel grooves, and wherein a panel extension is hingedly attached to said fourth panel.

9. A container comprising:

a body with four sides, rounded corners, a closed end, and an open end;

a lid with four sides, rounded corners, a closed end, and an open end, said lid hingedly secured to said body along a curved perimeter; and an inner frame having a front panel and at least two side panels, said inner frame secured to said body opposite said hinge, wherein said inner frame at least partially extends past said open end of said body and said lid contacts at least a portion of a top surface of said inner frame when said lid contacts said body opposite said hinge and wherein at least a portion of said inner frame is surrounded by said lid when said lid is in a closed position.

10. The container as in claim 9, wherein said inner frame comprises:

a plurality of parallel groves located at approximately the perimeter of said front panel and said at least two side panels.

11. The container as in claim 10, wherein said inner frame comprises a shoulder located adjacent to said parallel groves on said top surface of said inner frame, said shoulder extending from said parallel grooves to a curved surface on said front panel of said inner frame.

12. The container as in claim 11; wherein at least a portion of said top surface of said inner frame front panel has a cavity.

13. The container as in claim 12, wherein said cavity is u-shaped.

14. The container, as in claim 13, wherein said u-shape extends from said curved surface on said front panel to said body.

15. The container as in claim 9, wherein said lid and said body are formed from the same substrate by folding a portion of said substrate along a curved perimeter to form a hinge, a lid, and a body.

16. The container as in claim 9, wherein said container is suitable for holding cigarettes.

* * * * *